US007552546B2

(12) United States Patent
Cockburn

(10) Patent No.: US 7,552,546 B2
(45) Date of Patent: Jun. 30, 2009

(54) APPARATUS AND METHOD FOR PROVIDING OPEN-HEELED FOOT APPAREL WITH IMPROVED HEEL SUPPORT

(76) Inventor: Alistair Cockburn, 1814 Ft. Douglas Cir., Salt Lake City, UT (US) 84103

( * ) Notice: Subject to any disclaimer, the term of this patent is extended or adjusted under 35 U.S.C. 154(b) by 253 days.

(21) Appl. No.: 11/609,800

(22) Filed: Dec. 12, 2006

(65) Prior Publication Data

US 2007/0130798 A1 Jun. 14, 2007

(51) Int. Cl.
*A43B 3/12* (2006.01)
*A43B 3/00* (2006.01)

(52) U.S. Cl. ..... 36/11.5; 36/105; 36/34 R; 36/25 R; 36/140

(58) Field of Classification Search ..... 36/11.5, 36/105, 34 R, 25 R
See application file for complete search history.

(56) References Cited

U.S. PATENT DOCUMENTS 1,516,840 A * 11/1924 Butler ..... 36/140
2,362,010 A * 11/1944 Huff ..... 36/91
2,780,013 A * 2/1957 Voss ..... 36/105
3,121,962 A * 2/1964 Gullo ..... 36/11.5
3,413,977 A * 12/1968 Soble et al. ..... 36/142
5,481,814 A * 1/1996 Spencer ..... 36/138
6,526,676 B1 * 3/2003 Ledergerber ..... 36/11.5
6,708,426 B2 * 3/2004 Erickson et al. ..... 36/127
6,792,697 B2 9/2004 Wright et al.

* cited by examiner

*Primary Examiner*—Ted Kavanaugh
(74) *Attorney, Agent, or Firm*—Kunzler & McKenzie

(57) ABSTRACT

An article of foot apparel includes a platform curved to anticipate the natural movement of a foot. The article also includes a heel pad having a geometric center point; a retaining covering connected to the platform and configured to retain a foot at the front of the platform and to allow the heel of the foot to move freely. A substantial angle is created at the point of intersection of a line passing through the geometric center point of the heel pad and the center line of the retaining covering. The article of foot apparel conforms more closely to the actual physiology of the foot and allows the heel of the foot to remain centered in the heel pad when worn.

12 Claims, 8 Drawing Sheets

APPARATUS AND METHOD FOR PROVIDING OPEN-HEELED FOOT APPAREL WITH IMPROVED HEEL SUPPORT

BACKGROUND OF THE INVENTION

1. Field of the Invention

This invention relates to footwear and more particularly relates to open-heeled foot apparel.

2. Description of the Related Art

Open-heeled or backless footwear such as sandals, flip-flops, clogs, or the like are a popular clothing item worn by people of all ages in many areas around the world. Though popular as footwear, open-heeled foot apparel often causes discomfort to the wearer because the heel pad of the foot-receiving platform typically does not line up accurately with the actual contact area of the heel. Particularly when the foot is raised, such as when walking, the foot-receiving platform tends to swing toward the outer edge of the foot. As the foot comes down on the foot-receiving platform, the heel tends to contact the platform near the inner edge, which provides minimal support to the foot and often creates a worn heel-contact area off-centered from the available heel pad.

FIGS. 1A-1B illustrate one embodiment of a flip-flop 100 similar to those currently available on the market. Flip-flops 100 typically are a backless sandal held to the foot by a thong between the big toe and the second toe. The flip-flop 100 commonly comprises a platform 110, a heel pad 112, and a retaining covering 114 such as straps 114.

In certain embodiments, the platform 110 is made of a flat foam rubber with straps 114 attached at three contact points 116 and is generally shaped to contour the foot. Alternatively, flip-flops 100 and/or open-heeled foot apparel may be made from a variety of materials such as leather, wood, plastic, elastomer and the like. Some backless sandals even include a spiked heel and/or an inclined platform 110. The retaining covering 114 may comprise a single strap 114 or an intricate infrastructure. Those of skill in the art will recognize that flip-flops 100 and other backless footwear may be configured from a variety of materials. In addition, the platform 110, heel pad 112, and retaining covering 114 may be configured in a variety of styles and/or arrangements.

The retaining covering 114 may facilitate defining a centerline 118 that divides the area within the retaining covering 114 approximately equally. In the depicted embodiment, the centerline 118 passes through an approximate center of the platform 110 beginning from a midpoint 120 located between contact points 116*b* and 116*c*.

The heel pad 112 may include the lower portion of the platform 110. A geometric center point 122 may be identified for the heel pad 112. A line 124 passing through the center point 122 and the midpoint 120 may facilitate defining an angle 126. In certain embodiments, the angle 126 may represent the natural curve in the foot. Generally, the angle 126 may be insubstantial and may be about 180 degrees.

FIG. 1B illustrates an actual heel contact area 128 that has a center point 129. The heel contact area 128 is typically located near the inner edge 130 of the flip-flop 100. As the platform 110 swings during movement, the heel makes contact near the edge 130 of the platform 110, which offers a diminished amount of support to the heel. The inner edge 130 tends to break down quicker than the outer edge 132, creating an uneven, sloped platform 110. The user typically experiences discomfort as the heel pad 112 wears unevenly. In addition, the outer edge 132 of the flip-flop 100 typically boasts an excess of unused platform material. The excess material may annoy the user.

In shoes or footwear that have a heel retaining device or back, the problem is somewhat mitigated. In such an embodiment, the platform 110 and/or sole of the shoe is generally bound to the foot and does not typically swing, as is common with open-heeled footwear. As a result, the foot-receiving platform 110 generally remains in line with the foot, particularly the heel. Yet the demand for open-heeled footwear continues to remain high.

From the foregoing discussion, it should be apparent that a need exists for an open-heeled article of foot apparel that anticipates the swinging movement of the foot-receiving platform and positions the center of the heel pad where the heel of the foot is most likely to strike. Beneficially, such an article of foot apparel would provide popular open-heeled footwear that is comfortable to wear and is long-lasting. Providing a heel pad centered where the heel of the foot is most likely to strike would provide better heel support to the user and would potentially increase the life of the foot apparel.

SUMMARY OF THE INVENTION

The present invention has been developed in response to the present state of the art, and in particular, in response to the problems and needs in the art that have not yet been fully solved by currently available open-heeled footwear. Accordingly, the present invention has been developed to provide an article of foot apparel that overcomes many or all of the above-discussed shortcomings in the art.

The apparatus, in one embodiment, is configured to provide a curved platform for receiving a foot that anticipates the natural movement of the foot and comprises a heel pad having a geometric center point. The apparatus further comprises a retaining covering connected to the platform that retains a foot at the front of the platform and allows the heel of the foot to move freely. The retaining covering has a center line wherein a substantial angle is created at the point of intersection of a line passing through the geometric center point of the heel pad and the center line of the retaining covering. In certain embodiments, the substantial angle is more severe than the natural curve of the foot.

A method of the present invention is also presented for manufacturing an article of foot apparel. In one embodiment, the method includes providing a platform and a retaining covering having a centerline connected to the platform. The method also includes determining a heel contact area and aligning a heel pad to a center point of a heel contact area wherein a substantial angle is created at the point of intersection of a line passing through the geometric center point of the heel pad and the center line.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to give a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1A:
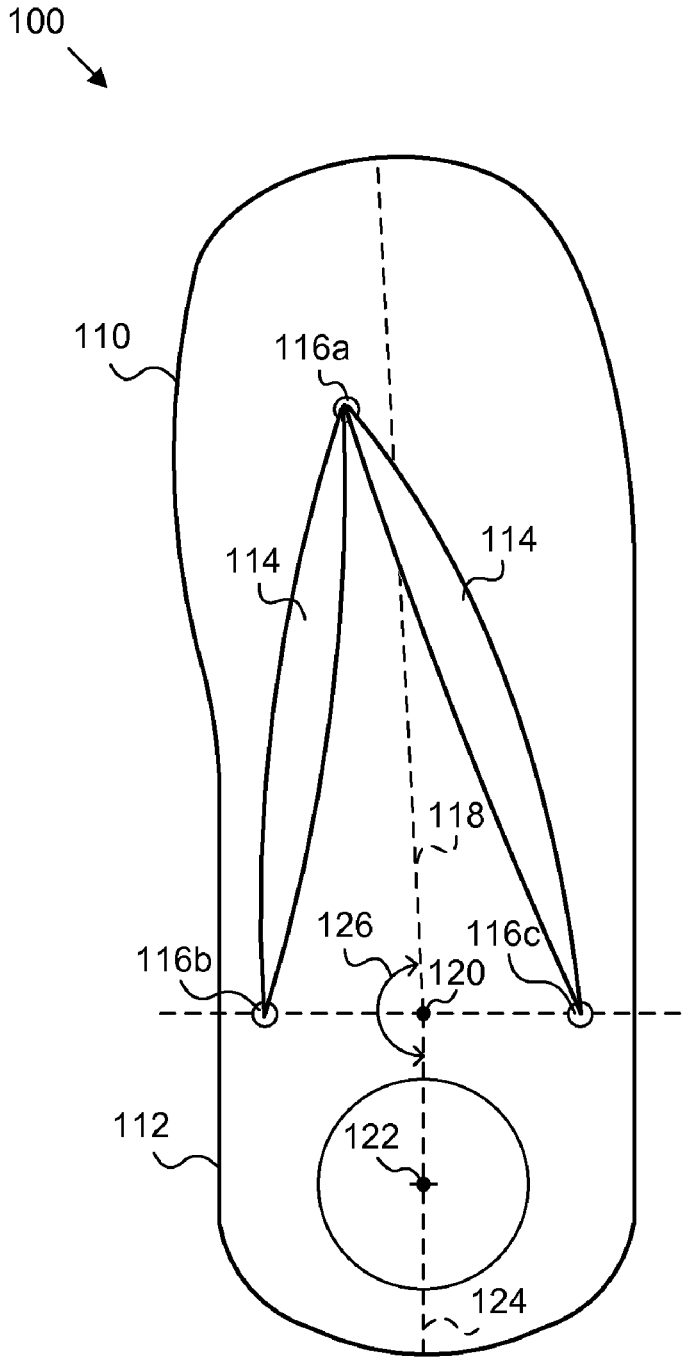
FIG. 1A PRIOR ART
FIG. 1A is a plan view illustrating one embodiment of a typical flip-flop with a centralized heel pad.
Figure 1B:
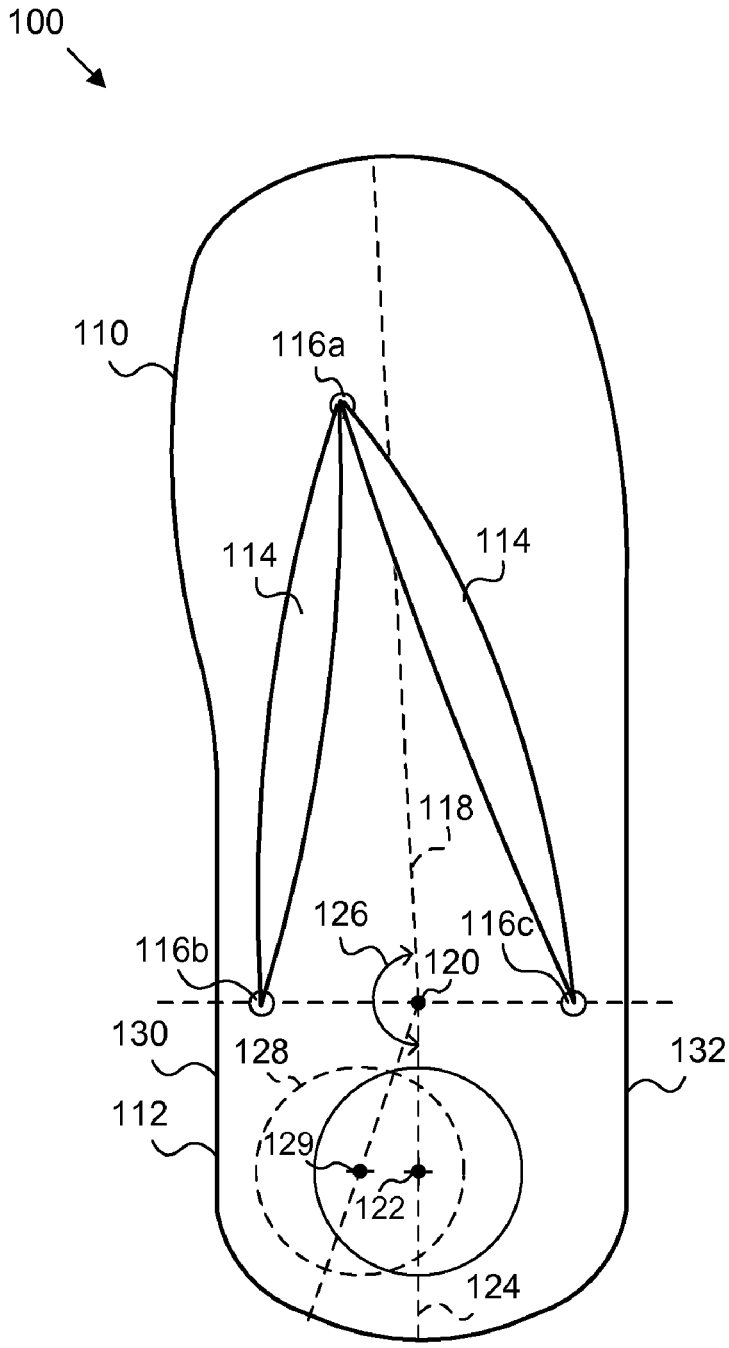
FIG. 1B PRIOR ART
FIG. 1B is a plan view illustrating one embodiment of a typical flip-flop with an offset heel contact area.
Figure 2A:
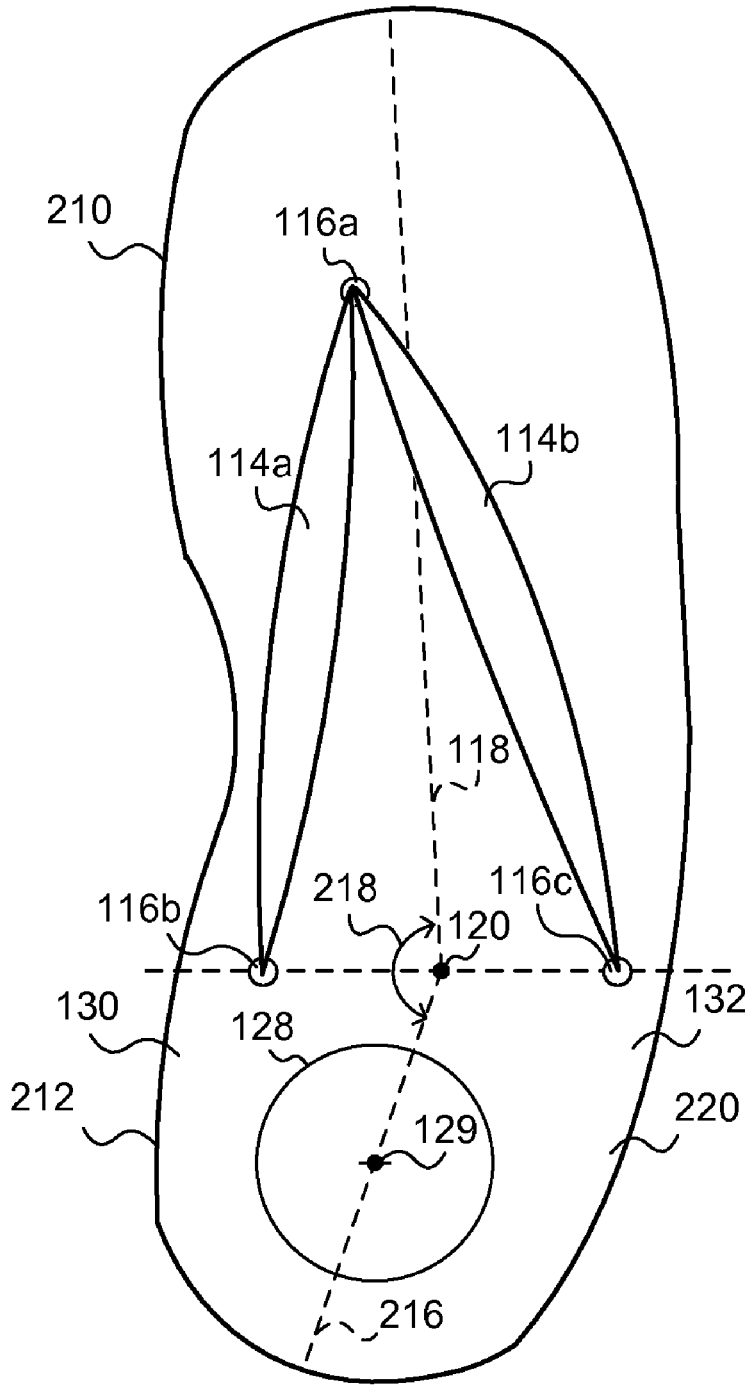
FIG. 2A is a plan view illustrating one embodiment of a flip-flop in accordance with the present invention.

FIG. 2A depicts one embodiment of a flip-flop 200 in accordance with the present invention. The flip-flop 200 is similar to the flip-flop 100 illustrated in FIGS. 1A-1B; however, a platform 210 includes a heel pad 212 angled to provide improved support to the heel of the wearer. In certain embodiments, the platform 210 is curved to anticipate the natural curvature and movement of the foot.

The curved platform 210, according to one embodiment, positions the heel pad 212 relative to the predicted heel contact area 128. In certain embodiments, the center point 129 of the heel contact area 128 comprises the approximate geometric center point of the heel pad 212. Aligning the heel pad 212 with the heel contact area 128 enables the heel to have substantial support on all sides. In addition, the heel pad 212 wears more evenly as the inner edge 130 receives about equal wear as the outer edge 132. Accordingly, the heel contact area 128 wears longer than with a traditional heel pad 112.

As mentioned, the traditional heel pad 112 may be aligned with the natural curvature of the foot represented by angle 126 in FIG. 1A. In theory, the heel pad 112 should provide centralized support to the heel. However, the movement and shape of the foot as well as the retaining covering 114 affect where the heel actually contacts the platform 110 and 210.

In the depicted embodiments, the straps 114 exert uneven pressure on opposing sides of the foot. The inner strap 114*a* typically exerts less pressure on the foot than the outer strap 114*b* under certain conditions. In one embodiment, when the foot is pressed down against the platform 110 and generally aligned with the shape of the platform 110, the outer strap 114*b* retains the foot by providing tension against the corresponding side of the foot. In contrast, the inner strap 114*a* under the same condition typically remains relatively loose.

When the wearer lifts her foot, however, the tension generally shifts from the outer strap 114*b* and becomes more balanced between the two straps 114*a* and 114*b*, causing the heel pad 112 of the platform 110 to swing outward. As the wearer steps down again, the tension of both straps 114*a* and 114*b* cause the heel to contact the platform in an offset position at about where the heel contact area 128 is outlined with a dotted line in FIG. 1B. Altering the configuration of the straps 114 would alter the tension on the foot, but the problem of outward movement and uneven wear on the heel pad 112 would remain.

Referring back to FIG. 2A, rather than altering the straps 114, the flip-flop 200 in the depicted embodiment adjusts the heel pad 212 to mitigate the problem. As a result, the user experiences greater comfort and improved heel support. The heel pad 212 is aligned with the movement of the foot in conjunction with the flip-flop 200. Uneven wear and related pains are minimized and extraneous platform material may be eliminated.

The intersection of the centerline 118 and a line 216 passing through the geometric center point 129 preferably creates a substantial angle 218. The upper portion of the flip-flop 200 with the retaining covering 114 may function as described above. Yet the curved platform 210 provides additional support to the heel when the wearer steps down on the platform 210. The curvature of the heel pad 212 prevents the outer edge 220 from swinging past the heel of the foot in certain embodiments.

The platform 210 and the heel pad 212 may or may not be a single unit. The heel pad 212 may be attached to the platform 210 in certain embodiments. In one embodiment, the heel pad 212 is personalized for the wearer and may be applied to an existing article of open-heeled footwear. The platform 210 may be altered to suit an individual wearer. In one embodiment, the superfluous platform material on the outer edge 132 may be removed and may be used to increase the support provided to the inner edge 130, creating a substantial angle 218. In another embodiment, additional material may be added to the inner edge 130 of an existing flip-flip 100 to increase the amount of support provided to the heel contact area 128.

In the depicted embodiment, the heel pad 212 curves at about where the retaining covering 114 contacts the platform at holes 116*b* and 116*c*. In certain embodiments, the curve or angle 218 is more severe than the natural curve of the foot illustrated in FIG. 1A, which is commonly emulated in footwear.

Figure 2B:
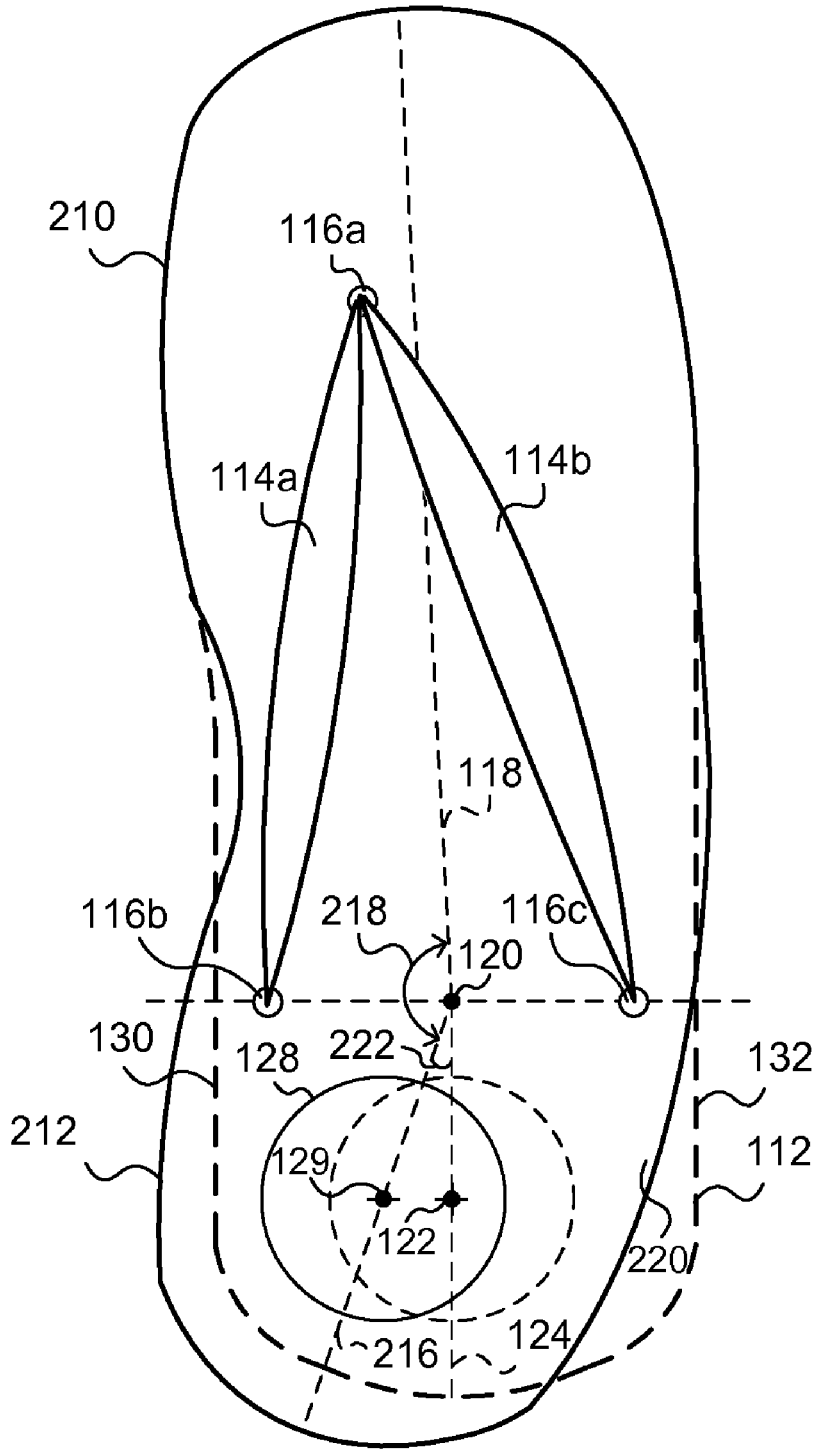
FIG. 2B is a plan view illustrating one embodiment of a flip-flop in accordance with the present invention relative to the flip-flop illustrated in FIGS. 1A-1B.

FIG. 2B illustrates the improved flip-flop 200 relative to the traditional flip-flop 100. The angle 222 may represent the amount of alteration of the curve 218 from the natural curve 126 of the foot illustrated in FIG. 1A. In certain embodiments, the curve 218 may be more severe than the natural curve of the foot by greater than 20 degrees with a preferred difference of about 30 degrees.

Figure 3:
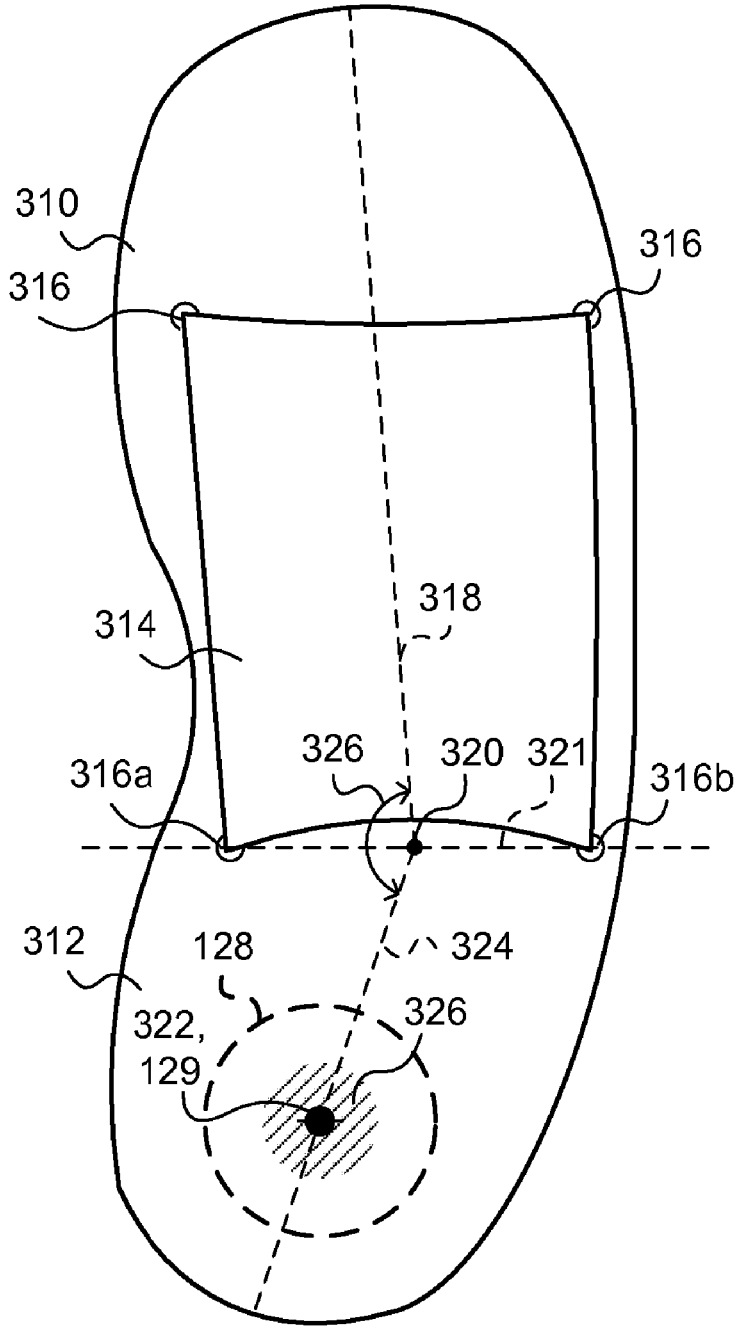
FIG. 3 is a plan view illustrating one embodiment of a sandal in accordance with the present invention.

FIG. 3 illustrates an alternative embodiment of a backless sandal 300 with a platform 310 for receiving a foot, a heel pad 312, a retaining covering 314, contact points 316, a centerline 318, a midpoint 320, and a geometric center point 322, which may align with the center point 129 of the heel contact area 128 in certain embodiments. The retaining covering 314 and the contact points 316 may facilitate defining the centerline 318, which approximately equally divides the area between the retaining covering 314.

In addition, the contact points 316*a* and 316*b* may define the midpoint 320 in certain embodiments. Alternatively, the midpoint 320 may be located above or below the line 321 that passes through contact point 316*a* and 316*b*. The midpoint 320 may be defined by the centerline 318 and the intersection point of line 324 in one embodiment. In the depicted embodiment, the line 324 passes through the geometric center point 322 and defines the approximate centerline of the heel pad 312. The heel pad 312 may be positioned relative to the heel contact area 128 as discussed above.

In certain embodiments, the geometric center point 322 of the heel pad 312 and the center point 129 of the heel contact area may be encompassed within the heel contact area 128 and/or within a central area 326 of the heel pad 312 and are not necessarily directly aligned. Those of skill in the art will recognize a benefit of the invention without precise alignment of well-defined points, such as the referenced geometric points 322, 129. Thus a projected central area 326 containing the geometric center point 322 and the heel contact center point 129 is within the scope of the invention.

The retaining covering 314 may comprise various shapes and forms as is known in the art. In the depicted embodiment, the retaining covering 314 comprises a single strap 314 connected to the platform 310. The foot may slide and the platform 310 may shift as discussed above. A heel contact area 128 may be determined and the heel pad 312 may be adjusted to support the heel and to anticipate regular motion.

Figure 4:
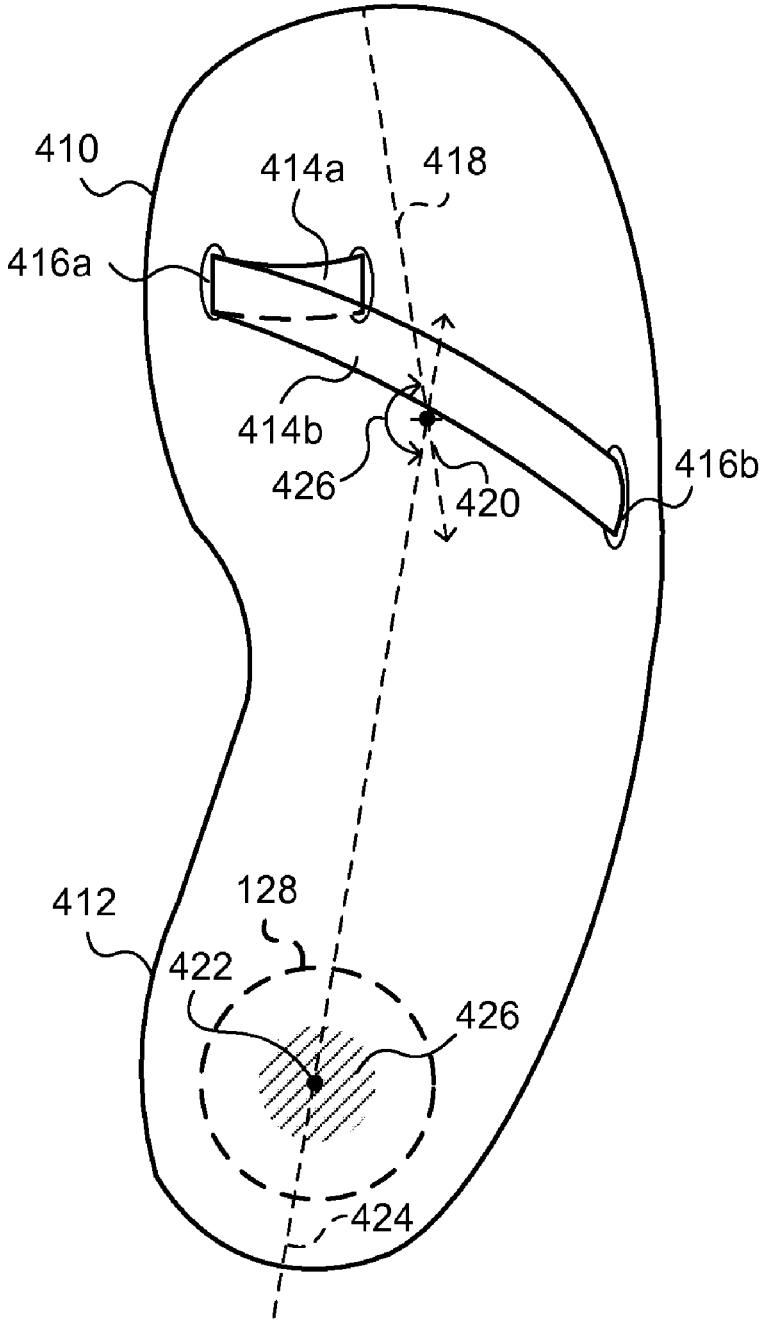
FIG. 4 is a plan view illustrating another embodiment of a sandal in accordance with the present invention.

FIG. 4 illustrates an alternative embodiment of a backless sandal 400. The sandal 400 as depicted includes a curved platform 410, a heel pad 412, a retaining covering 414, contact points 416, a centerline 418, a midpoint 420, and a geometric center point 422. The retaining covering 414, which comprises a toe strap 414*a* and an angled strap 414*b*, has an approximate centerline 418 that intersects with line 424 at about the midpoint 420, creating a substantial angle 426.

The midpoint 420 may be relative to the main strap 414*b* extending between contact point 416*a* and 416*b* in certain embodiments. Alternatively, the midpoint 420 may be relative to the established centerline 418 and the platform 410. The line 424, in the depicted embodiment, defines a line passing through the determined midpoint 420 and the geometric center point 422 of the heel pad 412.

The depicted style of sandal 400 benefits from substantially aligning the heel pad 412 with the heel contact area 128. The geometric center point 422 of the heel pad 412 consequently is located at a substantial angle from the center line 418 of the retaining covering 414. The angled heel pad 412 provides greater comfort and support to the user.

The schematic flow chart diagram that follows is generally set forth as a logical flow chart diagram. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Additionally, the order in which a particular method occurs may or may not strictly adhere to the order of the corresponding steps shown.

Figure 5:
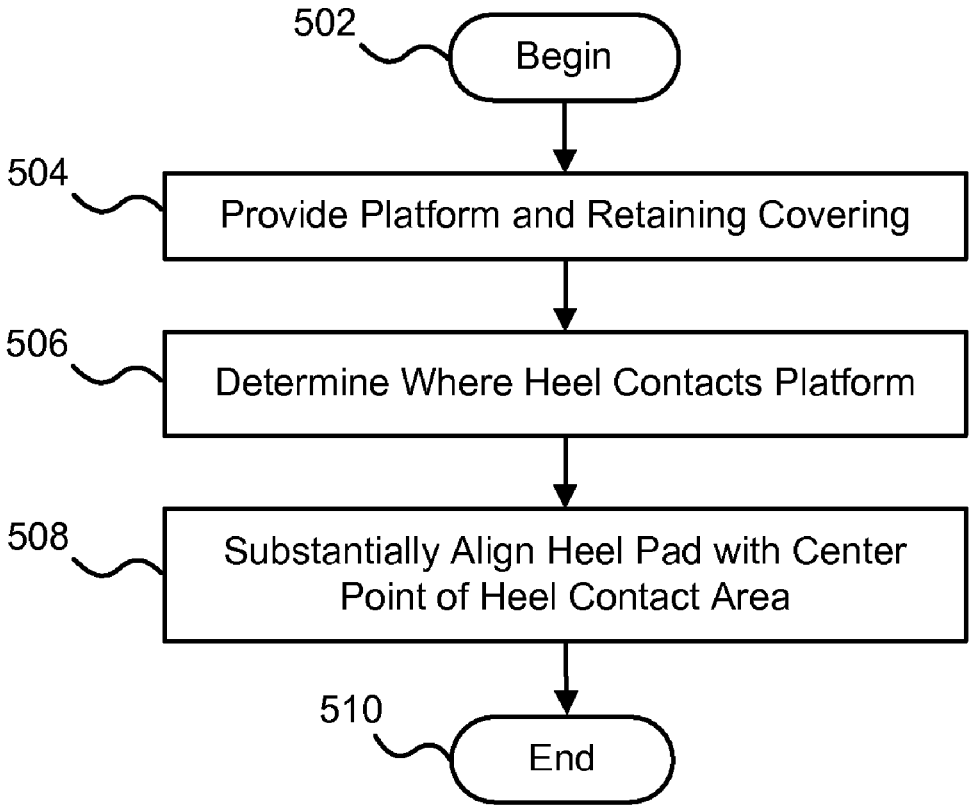
FIG. 5 is a schematic flow chart diagram illustrating one embodiment of a method for providing open-heeled foot apparel with improved support in accordance with the present invention.

FIG. 5 illustrates one embodiment of a method 500 for providing open-heeled footwear with improved heel support. The method 500 begins 502 and includes providing 504 an article of foot apparel having a platform and a retaining covering, determining 506 an actual heel contact area, and substantially aligning 508 the heel pad with the center of the heel contact area. Then the method 500 ends 510.

In certain embodiments, an article of open-heeled foot apparel may be customized to suit a particular foot and/or walking pattern. The heel pad may be aligned such that a substantial angle is created at the point of intersection of a line passing through the geometric center point of the heel pad and the center line of the retaining covering. The platform may be curved to anticipate the natural movement of the foot relative to the article of foot apparel.

In certain embodiments, the heel pad may be attached to the platform in order to substantially align 508 the heel pad with the center point of a heel contact area. In another embodiment, a platform may be formed as a single unit with a heel pad substantially aligned 508 with a center point of a heel contact area. In one embodiment, a platform material may be attached to the platform to supplement the support of the existing heel pad.

Figure 6:
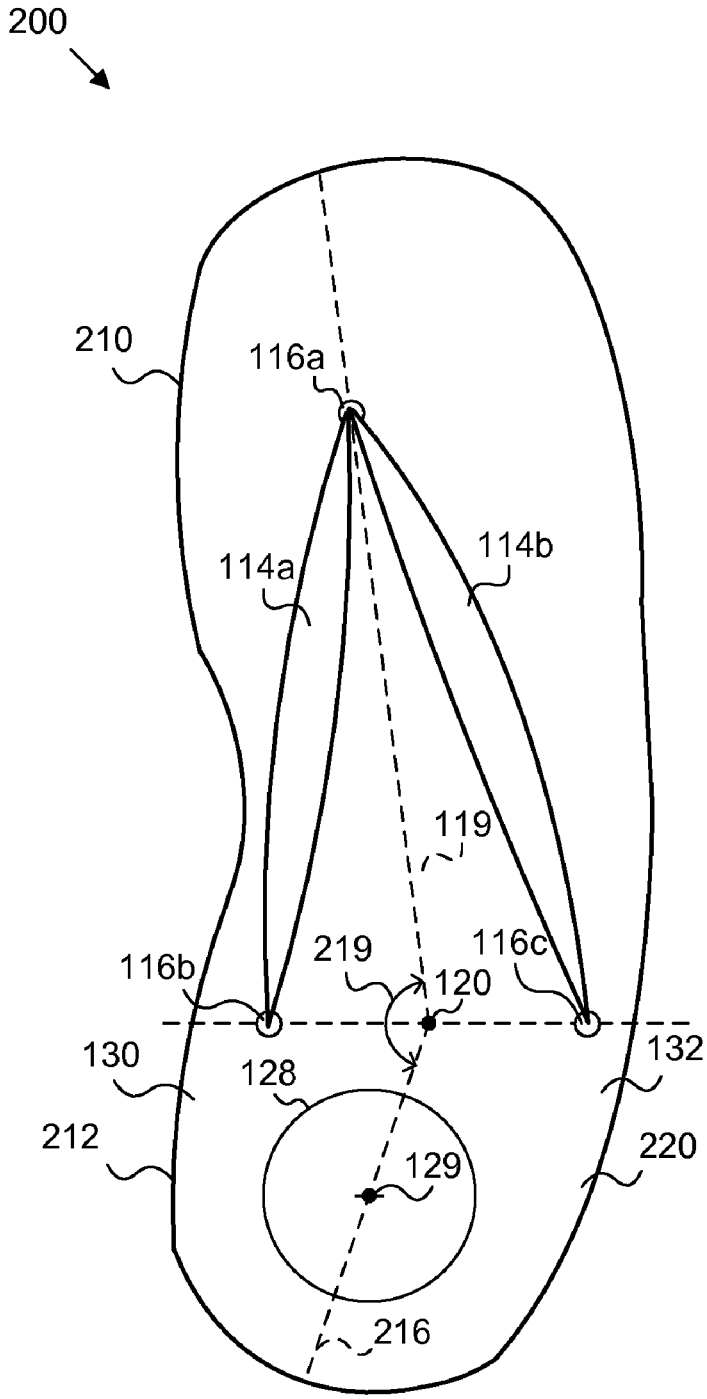
FIG. 6 is a plan view illustrating one embodiment of the sandal in accordance with the present invention.

FIG. 6 shows a further way of describing the curvature of the flip-flop 200 of the present invention. In this depiction, the intersection of the centerline 119 and the line 216 passing through the geometric center point 129 preferably creates a substantial angle 219. In certain embodiments, the curve or angle 219 is more severe than the natural curve of the foot illustrated in FIG. 1A, which is commonly emulated in footwear. In certain embodiments, the curve 219 may be more severe than the natural curve of the foot by greater than 20 degrees. In one embodiment, the angle 219 is about 30 degrees.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An article of foot apparel, the article comprising:

a platform for receiving a foot, the platform comprising a forward portion and a heel pad, the heel pad defining a first heel contact area and a second heel contact area inwardly offset from the first heel contact area, wherein the heel pad is inwardly curved relative to the forward portion to define the second heel contact area, the second heel contact area being defined about an approximate geometric center of the heel pad; and a retaining covering connected to the platform and configured to retain a foot at the front of the platform, the article being open-heeled to allow the heel of a foot retained by the retaining covering to move freely relative to the heel pad;

wherein the retaining covering is further configured to position the heel of a foot retained by the retaining covering substantially over the first heel contact area of the heel pad when the foot is initially retained by the retaining covering prior to a stepping event; and wherein during a stepping event, the retaining covering causes the platform to move outwardly away from the foot such that after the stepping event the heel of the foot is substantially over the second heel contact area.

2. The article of claim 1, wherein the forward portion is longitudinally aligned with a first centerline extending through a geometric center of the first heel contact area and the heel pad is longitudinally aligned with a second centerline extending through the geometric center of the heel pad, and wherein an acute angle defined between the first and second centerlines is greater than zero.

3. The article of claim 2, wherein the acute angle defined between the first and second centerlines is greater than 20 degrees.

4. The article of claim 2, wherein the acute angle defined between the first and second centerlines is greater than 30 degrees.

5. The article of claim 1, wherein the geometric center of the heel pad is the same as a geometric center of the second heel contact area.

6. The article of claim 2, wherein the retaining covering comprises a pair of straps connected to the platform and wherein the first centerline approximately equally divides the area between the straps.

7. The article of claim 6, wherein the straps exert uneven pressure on opposing sides of the foot when the foot is initially retained by the straps prior to a stepping event, and the straps exert a substantially even pressure on opposing sides of the foot during the stepping event.

8. An article of foot apparel, the article comprising:

a platform for receiving a foot, the platform comprising a forward portion coupled to a rearward heel pad, the heel pad having a geometric center point; and at least two straps connected to the platform and configured to retain a foot at the forward portion of the platform, each strap extending in a generally forward to rearward direction from approximately the same first location on the platform to separate spaced-apart second locations on the platform, wherein the article is open-heeled to allow the heel of a foot retained by the at least two straps to move freely relative to the heel pad;

wherein an acute angle defined between a first line passing through the first location and a midpoint between the spaced-apart second locations and a second line passing through the geometric center point of the heel pad and the midpoint between the spaced-apart second locations is at least approximately 20 degrees.

9. The article of claim 8, wherein the acute angle is at least 30 degrees.

10. The article of claim 8, wherein the geometric center point of the heel pad is substantially the same as the geometric center point of a heel contact area on the heel pad associated with the location a heel of a foot retained by the straps contacts during a stepping event.

11. The article of claim 8, wherein the first line approximately equally divides the area between the straps.

12. The article of claim 8, wherein the straps exert uneven pressure on opposing sides of a foot when the foot is initially retained by the straps prior to a stepping event, and the straps exert a substantially even pressure on opposing sides of the foot during the stepping event.

* * * * *